United States Patent [19]

Tottori et al.

[11] 3,989,974

[45] Nov. 2, 1976

[54] GAS DISCHARGE DISPLAY PANEL

[75] Inventors: Hiroshi Tottori; Shigemasa Yoshida; Fumihiko Isogai; Etsuo Hatabe, all of Amagasaki, Japan

[73] Assignee: Mitsubishi Denki Kabushiki Kaisha, Tokyo, Japan

[22] Filed: July 8, 1975

[21] Appl. No.: 594,015

[30] Foreign Application Priority Data

July 8, 1974 Japan ..... 49-78468

[52] U.S. Cl. ..... 313/217; 313/188; 313/201; 315/169 TV

[51] Int. Cl.[2] ..... H01J 61/06

[58] Field of Search ..... 313/217, 201, 188, 220; 315/169 TV

[56] References Cited

UNITED STATES PATENTS 3,559,190 1/1971 Bitzer et al. ..... 315/169 TV

*Primary Examiner*—R. V. Rolinec
*Assistant Examiner*—Darwin R. Hostetter
*Attorney, Agent, or Firm*—Oblon, Fisher, Spivak, McClelland & Maier

[57] ABSTRACT

A gas discharge display panel is disclosed for displaying images by selectively making luminescent cross points of main electrodes arranged to form the matrix through a discharge gap. The display includes a switching operation part which comprises auxiliary electrodes which are arranged in parallel to the main electrodes and to which a turn-on or turn-off pulse is applied and switching electrodes which cross the auxiliary electrodes to form the matrix through the discharge gap so as to select predetermined cross points of the auxiliary electrodes. The switching operation part is incorporated in the panel together with a display part comprising the main electrodes to form the matrix through the discharge gaps whereby switching circuits for switching each of the main electrodes which are complicated and expensive can be improved.

8 Claims, 10 Drawing Figures

GAS DISCHARGE DISPLAY PANEL

BACKGROUND OF THE INVENTION

Field of the Invention

CRTs (cathode ray tubes) have been widely used as display apparatus in the TV field and as output-input display apparatus for computers. Recently, plasma displays have been developed for use in place of CRTs. The plasma displays can be classified depending upon the driving method used, i.e., a DC type display driven by applying DC voltage and an AC type display driven by applying AC voltage. The DC type display has been widely used for miniature computers and meters which display figures and characters.

The present invention relates to an AC type plasma display which was disclosed in the Fall Joint Computer Conference in the U.S.A. on Nov. 1966 by H. D. Slottow and D. L. Bitzer of Illinois University.

The plasma display has the following unique characteristics: A memory function is incorporated in the plasma display itself. The purpose of the memory function is to provide a switching operation for switching the ON state and OFF state of picture elements by applying a turn-on or turn-off pulse while applying a sustaining drive voltage to the plasma panel. The plasma display is more suitable as the output-input display for a computer because of the characteristic of the memory function.

A CRT has no memory function so that a stationary image cannot be maintained without continuous refresh scanning. Moreover, the plasma display is a matrix array display in which picture elements are arranged in lattice form. Accordingly, the picture elements of luminescent points are usually stationary which yields an excellent image display having high accuracy. Furthermore, the panel is transparent and comprises a thin flat plate and has a simple structure, so that a large size panel can be easily prepared. Power consumption of the panel is relatively small and no crosstalk is present.

However, the plasma display has the following disadvantages: The states of the picture elements are only the two states of ON and OFF so that a half-tone is difficult to display. The discharge occurs in certain areas so that it is difficult to attain a high resolving power of less than 0.3 mm of the picture element pitch. The electrodes are arranged to form a matrix and each of the electrodes should be switched which complicates the switching circuit. The half-tone problem has been studied and overcome to provide an image having plural tones by a method of controlling the number of luminescent operations utilizing the difference of a wall voltage and a method of a time modulation within each frame display time. The resolving power problem is not serious because the resolving power of a TV set is usually 0.5 – 1.0 mm.

DESCRIPTION OF THE PRIOR ART

FIG. 1 is a schematic view of a typical panel structure of the conventional plasma display. In FIG. 1, plural linear electrodes 2 are disposed on a thick glass plate 1 and a dielectric layer 3 is formed by coating a thin layer of glass on the surface. A pair of the glass plates having plural electrodes are arranged with a discharge gap 4 (gas chamber) so as to cross two groups of the electrodes 2a, 2b. The peripheral part of the pair of glass plates is sealed with a sealant 5.

In the case of a plasma panel, the cross points of the two groups of the electrodes are picture elements of luminescent points. In general, the thickness of each of the dielectric layers 3a, 3b is 7 – 50 μm; the discharge gap 4 is 100 – 200 μm and the width of each of the electrodes 2a, 2b is 50 – 100 μm.

The resolving power is dependent upon the pitch of the electrodes. The glass plate 1 is thick enough so as not to be broken by the vacuum of the discharge gap 4, and can be 3 – 10 mm. Accordingly, the total thickness of the panel is usually about 6 – 20 mm.

In the discharge gap 4, a dischargeable gas such as neon or argon is used. In order to drive the plasma display panel, a sustaining drive voltage Vm having an AC rectangular waveform which has a 180° phase difference and is lower than the discharge initiation voltage shown in FIG. 2 (*a*), (*b*) is always applied to the two groups of the electrodes wherein the X electrodes designate the transverse electrodes $2a_1$ - $2a_i$ and the Y electrodes designate the vertical electrodes $2b_1$ - $2b_i$. Accordingly, the voltage applied to the discharge gap 4 has the waveform of FIG. 2(*c*).

When turn-on of the picture element is required, the turn-on pulse voltage $v_a$ having a half level of that of the turn-on pulse $v_p$ applied to the discharge gap is applied to two electrodes which are crossed at the picture element in reverse polarity respectively. The pulse voltage $v_p$ added to the sustaining voltage exceeds the discharge initiation voltage $v_f$ as shown in FIG. 2.

At the other picture elements, no discharge is caused because only half of the voltage of the turn-on pulse voltage $v_p$ is applied so that the discharge initiation voltage $v_f$ is not reached. When a discharge occurs at the picture element, the discharge continues intermittently under application of only the sustaining drive voltage at each of the times of reversing the polarity of the sustaining drive voltage $v_m$. This is the memory function.

The phenomenon of the sustained discharge is considered to be caused by the fact that the ions and electrons caused by the discharge are accelerated by the electrode voltage to reach the opposite dielectric layer 3 and the ions and electrons are charged to form the wall voltage $v_w$. The wall voltage $v_w$ is shown in FIG. 2(*d*) as a dot chain line.

The ions and electrons are moved in the direction which decreases the electrode voltage and reach the dielectric layer 2 to form the wall voltage $v_w$. Accordingly, the voltage polarity is opposite to that of the electrode.

When the voltage polarity of the sustaining drive voltage $v_m$ is reversed, both of the polarities are the same. Even though the sustaining drive voltage is lower than the discharge initiation voltage, the composite voltage of both voltages is higher than the discharge initiation voltage shown in FIG. 2. Accordingly, the discharge occurs. The phenomenon is repeated and the discharge is intermittently continued at each of times of reversing the polarity of the sustaining drive voltage whereby the luminescent point is maintained.

In order to stop the discharge condition, the wall voltage $v_w$ is eliminated. Various methods have been proposed. A typical method is to apply a turn-off pulse at the time shown in FIG. 2 (*a*), (*b*), to cause a small discharge to eliminate the wall voltage $v_w$.

The frequency of the sustaining drive voltage $v_m$ is 10 – 100 KHz, and the luminescent degree of the picture element increases depending upon the frequency. The voltage is about 130 – 200 volts. The pulse width of the turn-on pulse and the turn-off pulse is several $\mu$ to several tens $\mu$ seconds. The voltages of the turn-on pulse and the turn-off pulse for application to one electrode is substantially the same and is 40 – 80 volts.

When the plasma display is used as a character display or a graphic display for displaying the output of a keyboard or a computer, the circuit systems can be classified as a high voltage switching circuit for applying the turn-on pulse $v_a$ and the turn-off pulse $v_d$ to the plasma panel and a control circuit for processing the input from a keyboard or a computer to generate the gate pulse for the switching circuit. The switching circuit for selectively applying the turn-on pulse $v_a$ and the turn-off pulse $v_d$ with the AC sustaining drive voltage $v_m$ is usually complicated.

FIG. 3 shows a circuit diagram of one embodiment of a conventional switching circuit. In the circuit, AND circuits comprising one resistor 6 and two diodes 7, 8 are provided in the matrix array. The terminal $E_1$ is connected to each electrode 2 of the display panel. The sustaining drive voltage is applied from the terminal Ts through the point *a*, the diode 7 and the terminal $E_1$ to each of the electrodes 2. During this time, the switch elements S*a* are in the ON state and the transistors S*b* are in the OFF state.

The voltage for charging the dielectric layer 3 is discharged through the terminal $E_1$, the diode 8 and the switch element S*a* by a selective turn-on of the switch element S*a*. The turn-on or turn-off pulse voltage is applied from the other system of the battery $V_B$ with the AC sustaining drive voltage $v_m$. The voltage which is substantially the same as the power voltage $v_m + v_B$ can be applied through T*s* - V*b* — transistor S*b*-resistor 6-terminal $E_1$ to a desirable electrode by switching to the ON state of the transistor S*b* and to the OFF state of the switch element S*a*. The selection of the electrode for applying the pulse can be independently made depending upon the selection of the terminals T*a*, T*b* for applying a gate pulse.

However, in the conventional switching circuit, it is necessary to provide more than three electric circuit elements for each electrode 2 of the panel. When the contacts of the switching circuit and the electrode terminals of the panel number 256, 512 and the like, the switching circuit is quite complicated and expensive and is unduly space consuming whereby the reliability of the switching circuit is undesirably low.

SUMMARY OF THE INVENTION

It is therefore an object of the present invention to provide a gas discharge display panel which overcomes the disadvantages of conventional technology and which has a novel switching operation part which conducts a switching operation by utilizing a voltage drop caused by a gas discharge.

It is another object of the present invention to provide a gas discharge display panel which comprises a display part and a switching operation part in the panel without providing a switching circuit exterior of the panel.

It is a further object of the present invention to provide a gas discharge display panel wherein a simple signal system is used and the number of lines required for the panel and outer interface can be remarkably small.

It is a still further object of the present invention to provide a gas discharge display panel occupying only a small amount of space resulting in economy.

The foregoing and other objects are attained in accordance with one aspect of the present invention through the provision of a gas discharge display panel comprising a display part comprising main electrodes disposed to form a matrix through a discharge gap to form plural picture elements by generating luminescent dots at cross points of the main electrodes, and a switching operation part comprising auxiliary electrodes arranged with the main electrodes to control the initiation and the termination of the discharge at selected cross points of the main electrodes, and switching electrodes respectively arranged to cross the auxiliary electrodes through the discharge gap and to select cross points of the auxiliary electrodes for discharge.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 4:
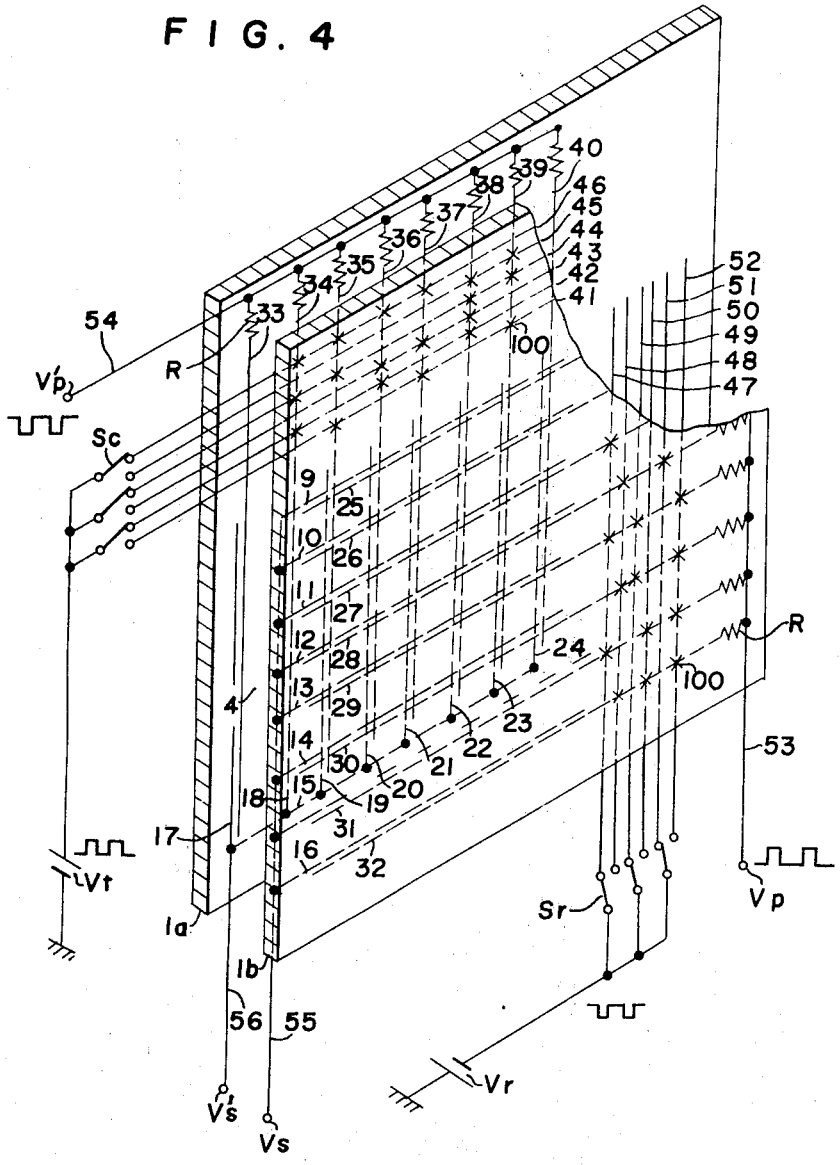
FIG. 4 is a schematic partially broken view of one embodiment of a plasma display panel according to the present invention.

Referring now to the drawings, wherein like reference numerals designate identical or corresponding parts throughout the several views, and more particularly to FIG. 4 thereof, FIG. 4 is a schematic partially broken view of one embodiment of the AC type plasma display panel according to the present invention which has the switching operation part utilizing a voltage drop caused by the gas discharge. The main difference between this panel as compared to the conventional panel is to provide electrodes for applying the turn-on or turn-off pulse (hereinafter referred to as auxiliary electrodes) 25 – 32, 33 – 40 and switching electrodes 41 – 46, 47 – 52 for selectively applying the turn-on pulse to the auxiliary electrodes.

The auxiliary electrodes 25 – 32, 33 – 40 are respectively disposed on the surfaces of the substrates 1*b* and 1*a*, and are disposed adjacent and parallel to the main electrodes 9 – 16, 17 – 24 to which the AC sustaining drive voltage $v_m$ is applied, and are respectively connected through the resistors R and each of common lines 53, 54 to the outer electrodes $V_p$, $V'_p$. Only the turn-on or turn-off pulse is applied between the auxiliary electrodes however, the AC sustaining drive voltage is not applied.

On the other hand, the switching electrodes 41 – 46, 47 – 52 are disposed at places to prevent crossing the main electrodes on the surfaces of the substrates 1*b*, 1*a* so as to partially discharge between the switching electrodes and the auxiliary electrodes 33 – 40, 25 – 32 depending upon the below mentioned rule. That is, a part of the switching electrode is disposed in the discharge gap 4 and the other part of the switching electrode is covered with the dielectric 100 (designated in the drawing as an X symbol) so as to prevent the discharge.

Figure 1:
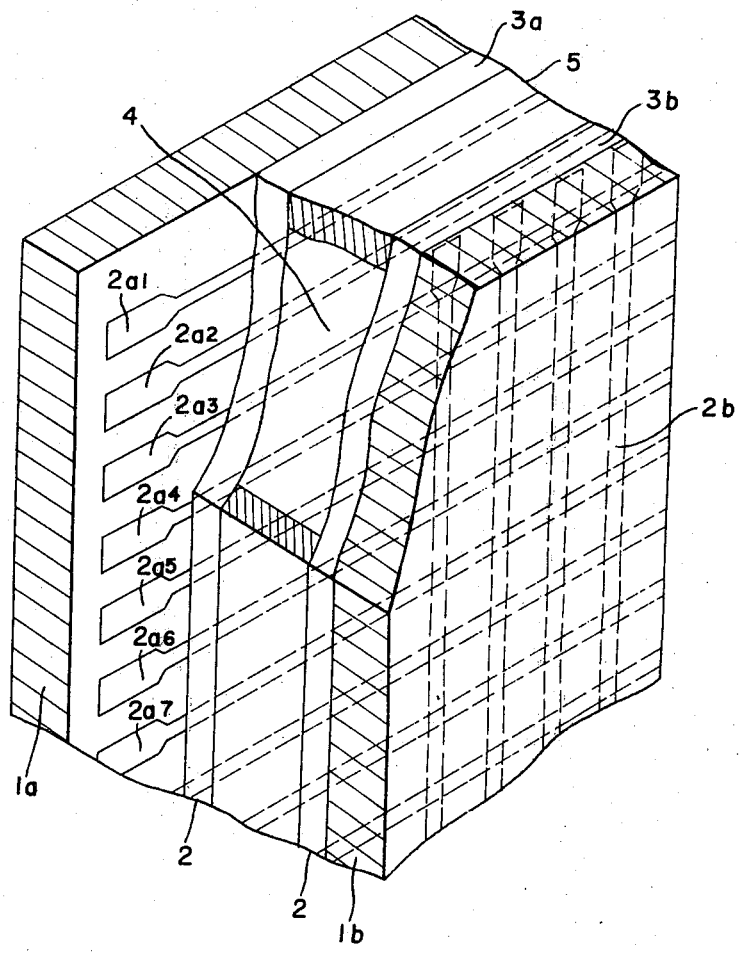
FIG. 1 PRIOR ART
FIG. 1 is a schematic partially broken view of a conventional AC drive type plasma display panel.
Figure 2:
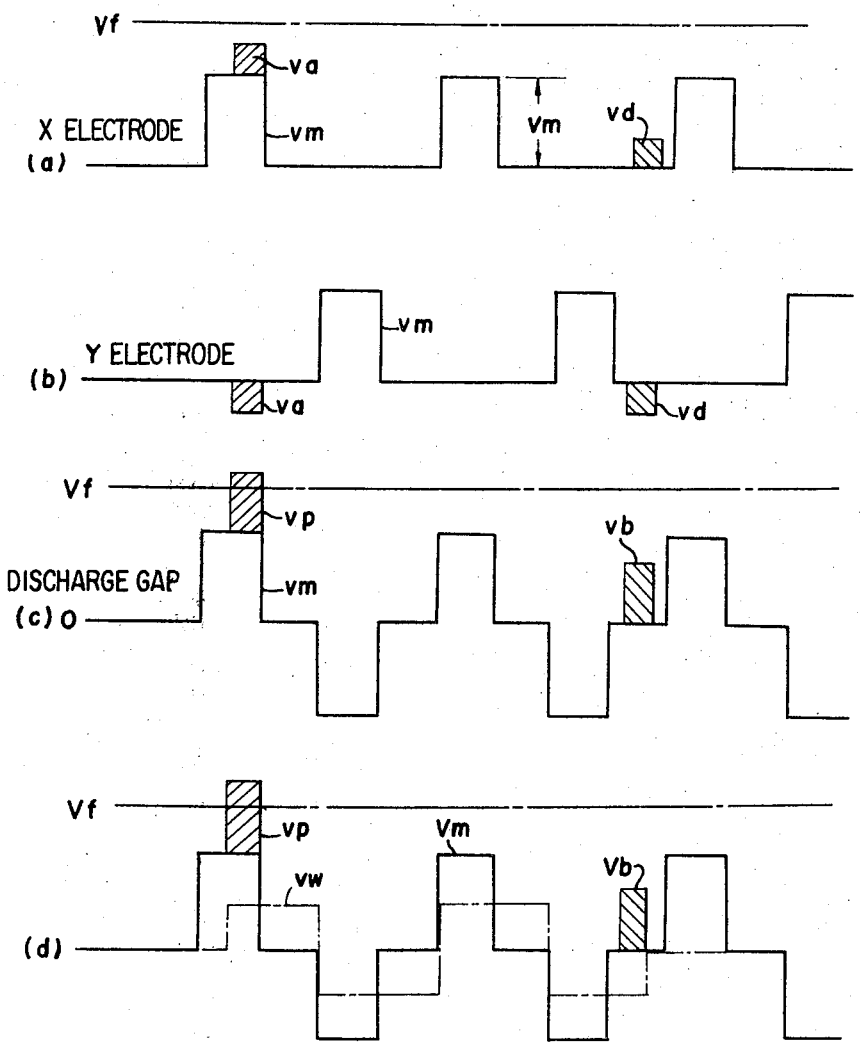
FIG. 2 PRIOR ART
FIGS. 2*a* – *d* are waveforms for illustrating applications of voltage to electrodes of a plasma display panel.
Figure 3:
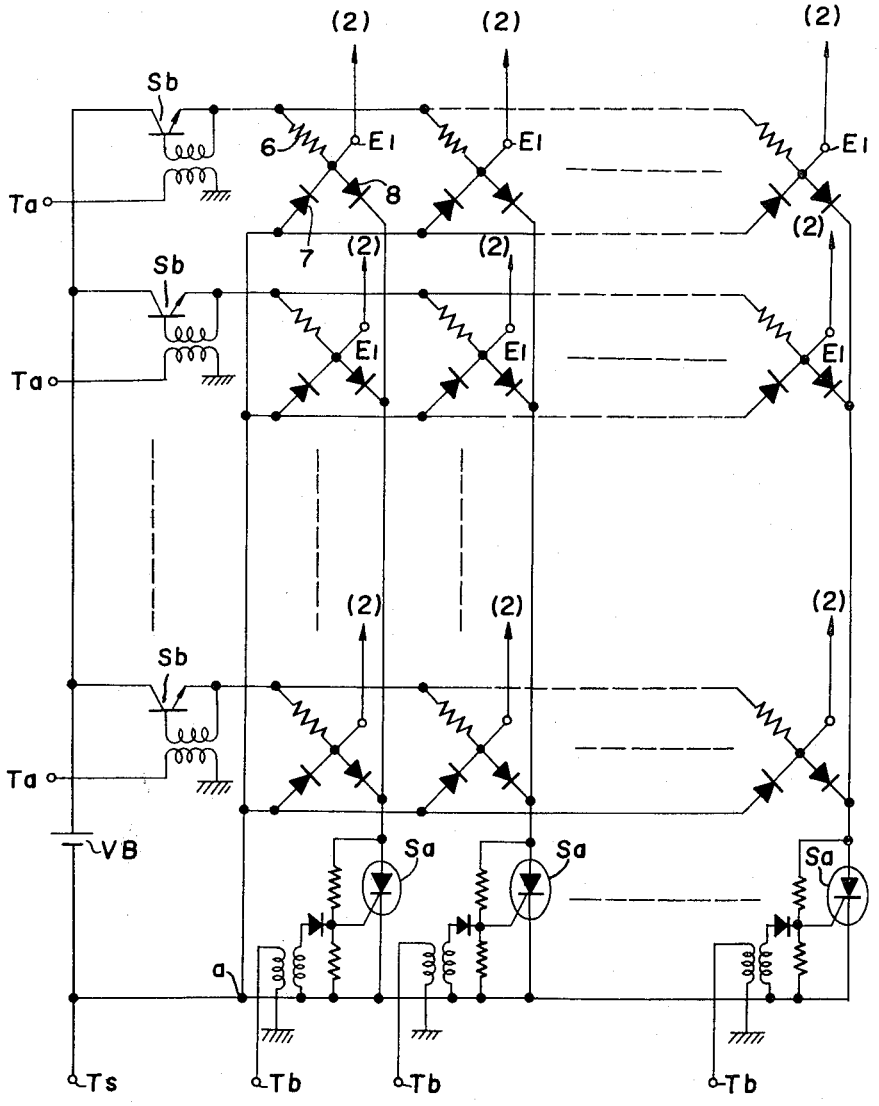
FIG. 3 PRIOR ART
FIG. 3 is a circuit diagram of a conventional switching circuit for selectively applying turn-on and turn-off pulses $v_a$, $v_d$ with an AC sustaining drive voltage $v_m$.

In order to drive the display panel, the AC sustaining drive voltage $v_m$ of FIG. 2 is always applied through the outer electrodes V*s*, V's to the main electrodes 9 – 16, 17 – 24 which are connected to each of the common lines 55, 56. Thus, the turn-on or turn-off pulse voltages $v_a$, $v_d$ are respectively applied to the common outer electrodes $V_p$, $V'_p$ and are applied through each of the resistors R to the auxiliary electrodes 25 – 32, 33 – 40.

When a negative voltage having the same phase as the turn-on and turn-off pulses is applied to electrodes selected from the switching electrodes 41 – 46, 47 – 52, discharge is caused at the cross points between the switching electrodes and the auxiliary electrodes. The voltage drop of the discharged auxiliary electrode is caused by the voltage drop given by the resistor R and voltage having substantially the same level as the applied voltage is applied to the other auxiliary electrodes which are not discharged between the switching electrodes and the auxiliary electrodes.

Figure 5:
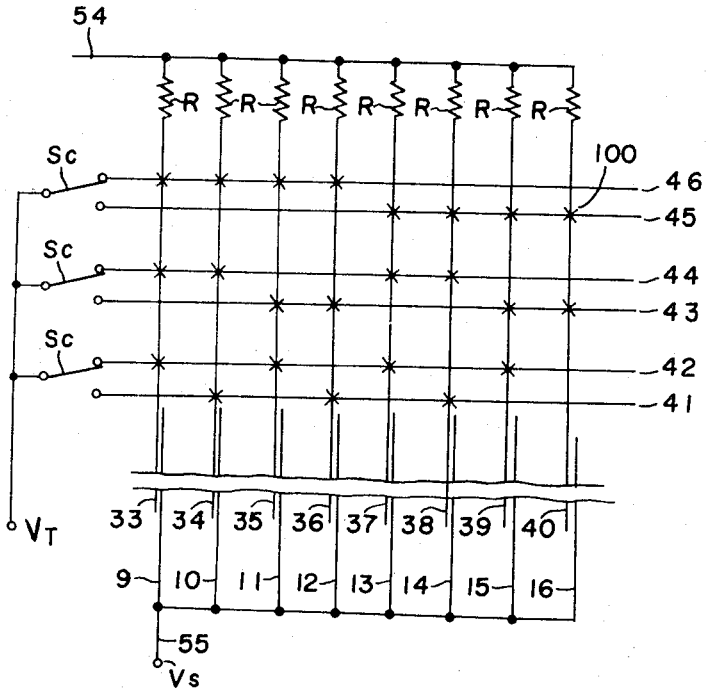
FIG. 5 is a network diagram of a switching operation part of the embodiment of FIG. 4.

FIG. 5 illustrates the conditions of selection of the turn-on pulse or the turn-off pulse wherein eight electrodes are considered. The dischargeable positions (the points other than the parts having X symbols in the drawing) at the cross points between the auxiliary electrodes 33 – 40 and the switching electrodes 41 – 46 are decided by the binary system.

Referring to FIG. 5, the case of an application of the turn-on pulse to the auxiliary electrode 33 will be illustrated.

The switch Sc connected to the power source of voltage $v_t$ is connected to the switching electrodes 42, 44, 46. When the discharge initiating voltage at the discharge gap is $v_f$, the voltage $v_t$ is kept at $-v_f+5$ volts. When a positive turn-on pulse voltage is applied to the terminal $V'_p$ under this condition, the pulse voltage is applied through the resistors R to the auxiliary electrodes 33 – 40.

When the voltage of the auxiliary electrodes 34 – 40 rises from zero level to the +5 volt level, the discharge is caused between the four auxiliary electrodes 37 – 40 and the switching electrodes 46; between the two auxiliary electrodes 35, 36 and the switching electrode 44; and between the auxiliary electrode 34 and the switching electrode 42. Accordingly, the voltage does not rise more than 5 volts. Thus, a turn-on pulse having substantially the same potential as the turn-on pulse applied to the terminal $V'_p$ is applied only to the auxiliary electrode 33 which does not cause a discharge.

The potentials of the other auxiliary electrodes except the auxiliary electrode 33 are dependent upon the conditions of the discharges. In general, the potentials are given by the volt-ampere characteristics of FIG. 6.

Figure 6:
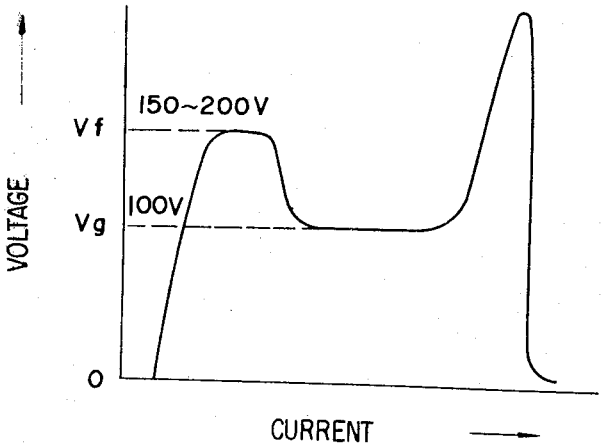
FIG. 6 is a graph of a volt-ampere characteristic in a gas discharge for illustrating a principle of the invention.

In FIG. 6, $v_f$ designates a discharge initiating voltage and $v_g$ designates the sustaining voltage at the glow discharge (discharge voltage). The potential of the switching electrode to which the negative potential is applied for the discharge can be selected to be in a certain range depending upon a memory margin of the display panel and is not limited to the potential of $-v_f+$ 5 volts.

Both of the turn-on pulse voltages are applied to the crosses between the auxiliary electrode 33 (to which the turn-on pulse voltage is selectively applied) and the selected auxiliary electrodes 25 – 32 whereby the discharge is initiated when the pulse voltage become higher than the discharge initiating voltage $v_f$ at the discharge gap 4. Thus, the case of the application of the turn-on pulse voltage to the auxiliary electrode 33 is illustrated.

When the turn-on pulse is applied to the other auxiliary electrodes, the switch S*c* is selected whereby it is possible to apply the turn-on pulse in a manner similar to its application to auxiliary electrode 33. For example, when both of the switching electrodes 46, 45 are in the first bit, the case selecting the switching electrode 46 designates "0" and the case selecting the switching electrode 45 designates "1". In the second bit of the switching electrodes 44, 43 and the third bit of the switching electrodes 42, 41, the even number switching electrodes designate 0 and the odd number switching electrodes designate 1 in the same manner.

When the first auxiliary electrode 33 is selected, the first bit is 0; the second bit is 0; the third bit is 0 to form 000. In the same manner, this is shown by the binary system as the second auxiliary electrode 34: 001; the third auxiliary electrode 35: 010; 011; 100 . . . In the same manner, the turn-on pulse voltage can be applied between the auxiliary electrodes 25 – 32 and the switching electrodes 47 – 52 by selecting the switch Sr.

Even though the auxiliary electrodes 25 – 32, 33 – 40 for applying the turn-on and turn-off pulses are separated from the main electrodes 9 – 16, 17 – 24 for applying the AC sustaining drive voltage $v_m$, if they approach, the voltage with the case of one electrode is applied across the discharge gap 4 because of the dielectric layer 3 between the discharge gap 4 and the electrodes so that it is possible to turn-on and to turn-off and to maintain the ON state. Thus, the case of applying the turn-on pulse is illustrated. The turn-off pulse can be applied in the same manner.

When a negative turn-on pulse is applied, it is possible to operate it by applying a potential having a reverse polarity to the terminals $V_p$ and $V_t$.

The resistors R can be easily formed on the surface of the substrate 3 by the vacuum deposition method or by the thick membrane coating method. In the case of the vacuum deposition method, it is suitable to deposit a metal having high resistance such as chromium.

In the example of FIG. 5, the switching operation is mainly for a graphic display for displaying the selections of each of the picture elements. In a character display for displaying characters, the line at a time system which can display several elements at the same time has the advantage of a short access time.

Figure 7:
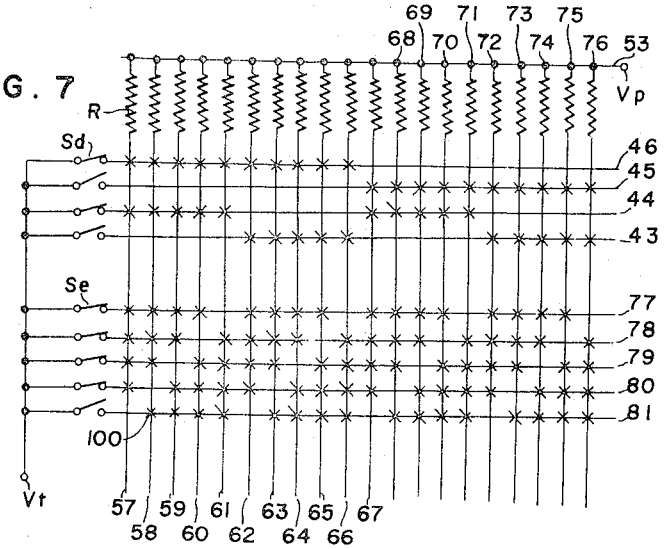
FIG. 7 is a diagram of a switching operation part for a character display.

FIG. 7 shows one embodiment of the switching operation part for this system wherein four switching electrodes 43 – 46 for selecting a character position and five switching electrodes 77 – 81 for selecting a character pattern are arranged to cross twenty auxiliary electrodes 57 – 76. When the switches for selecting character position Sd and the switches for selecting character pattern Se are in the ON states and the OFF states as shown in FIG. 7, the discharge is caused only at the cross points which have no coated dielectric layer 100 for preventing discharge, and the voltage drops are located. Accordingly, the turn-on pulse applied to the terminal $V_p$ is applied to only five auxiliary electrodes 57 – 61. The turn-on pulse is further selected by the switches for selecting character pattern Se whereby the voltage is applied only to the auxiliary electrode 57. Accordingly, when the switches for selecting character pattern Se are in the OFF state, the voltage is applied to the five auxiliary electrodes 57 – 61 whereby five picture elements are turned on at the same time. As stated above, it is possible to display desirable patterns at the same time by selecting the switches Se.

Figure 8:
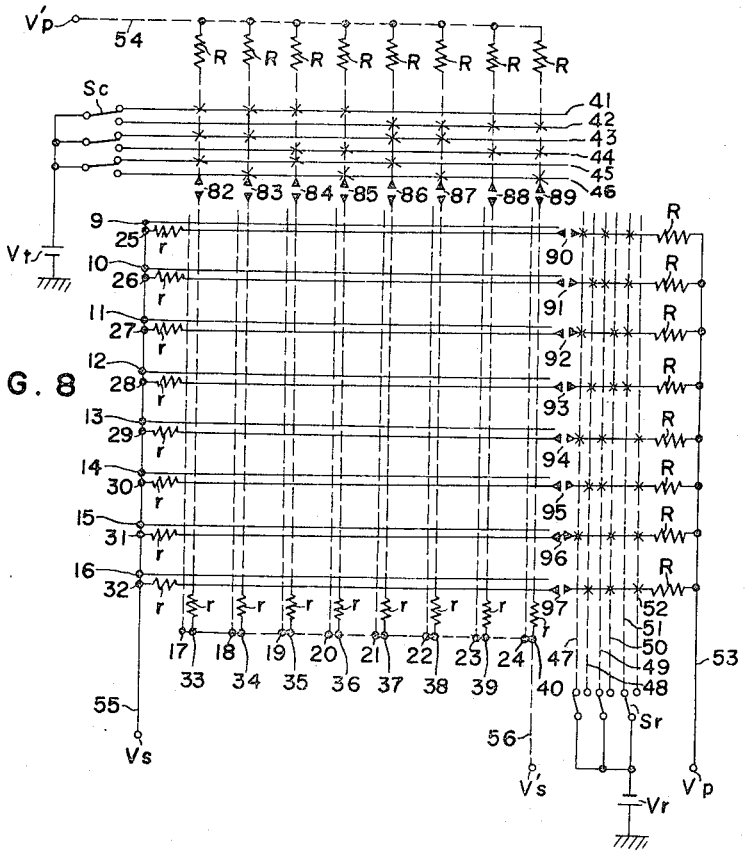
FIG. 8 is a diagram of another embodiment according to the invention.

FIG. 8 shows another embodiment of the invention wherein the auxiliary electrodes 25 – 32, 33 – 40 are cut to form spaces 82 – 97 between the display part and the switching operation part whereby it is possible to discharge across the gaps and to maintain electrical insulation by the gap. On the other hand, the other ends of the auxiliary electrodes 25 – 32, 33 – 40 are connected through the resistors *r* to the outer electrodes 55, 56 connected to the main electrodes.

In FIG. 8, the full lines show X electrodes and the broken lines show Y electrodes. The feature of the display panel of FIG. 8 is to conduct the discharge switching operations at the spaces 82 – 97 and at the cross points between the auxiliary electrodes 25 – 32, 33 – 40 and the switching electrodes 47 – 52, 41 – 46 so that the potentials of the parts of the auxiliary electrodes having no pulse application near the main electrodes are clamped to the AC sustaining voltage through the resistors *r*.

In the embodiment of FIG. 4, the potential of the auxiliary electrodes to which the pulse is not applied depends upon the discharge voltage between the auxiliary electrodes and the switching electrodes and there therefore is the possibility of discharge at the crosses of the auxiliary electrodes. Accordingly, it is disadvantageously difficult to realize a high discharge voltage.

On the contrary, in the embodiment of FIG. 8, the voltage at the cross points can be clamped to the AC sustaining drive voltage so that a stable operation can be realized and the S/N ratio of the image can be improved.

Figure 9:
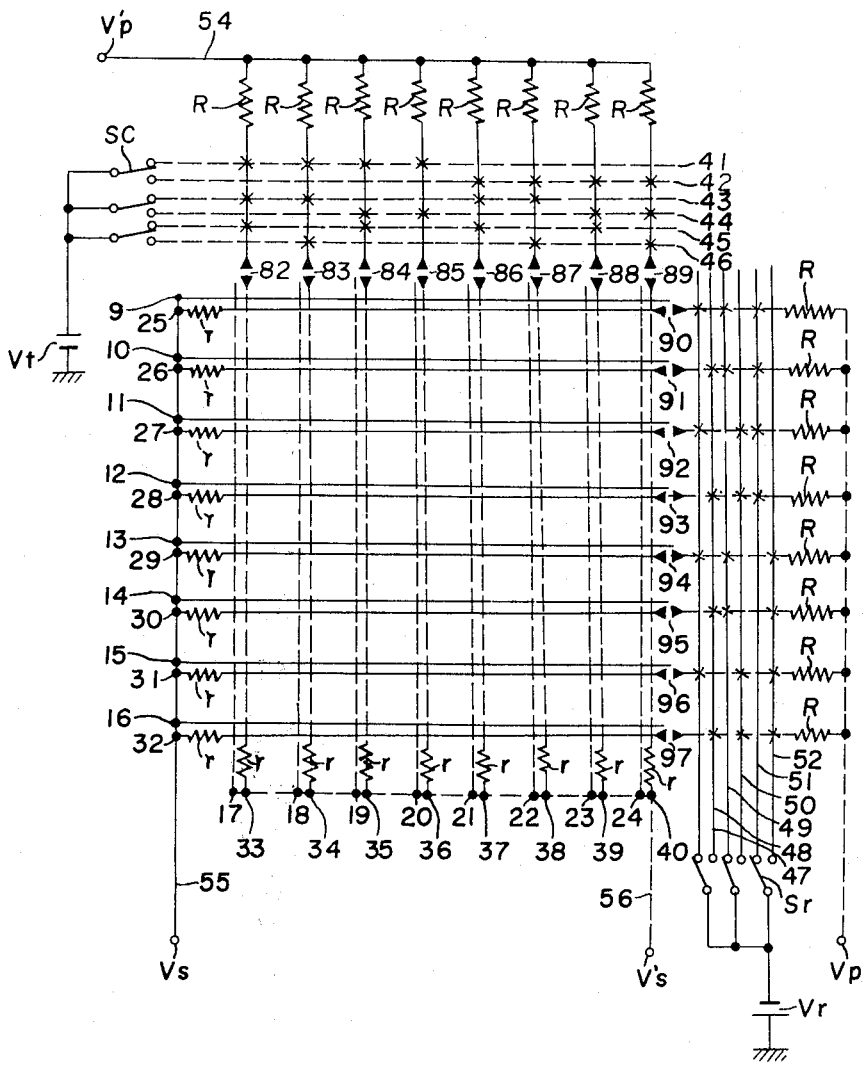
FIG. 9 is a diagram of another embodiment according to the invention.

FIG. 9 shows another embodiment of the invention. In the embodiment of FIG. 8, the spaces 82 – 97 of the auxiliary electrodes are formed between the display part and the switching operation part and both are on one surface of the glass substrate. On the contrary, in the embodiment of FIG. 9, both groups of electrodes for forming the spaces 82 – 97 face each other on the different substrates. Accordingly, the relation of the switching electrodes 41 – 46 shown by the full lines and the auxiliary electrodes 33 – 40 shown by the dotted lines in the switching operation part shown in FIG. 8 is opposite to that shown in FIG. 9. The relation of the switching electrodes shown by the dotted lines and the auxiliary electrodes shown by the full lines in the switching operation part shown in FIG. 8 is opposite to that shown in FIG. 9. The others are the same.

Figure 10:
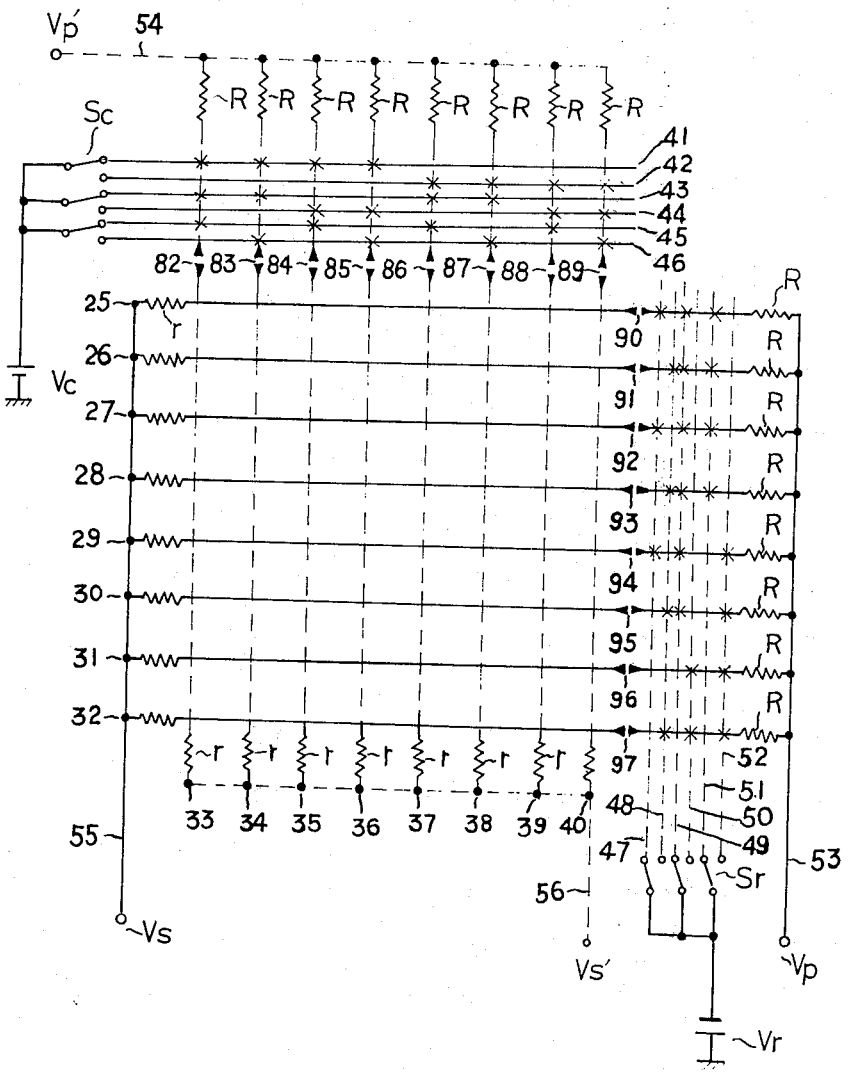
FIG. 10 is a diagram of another embodiment according to the invention.

FIG. 10 shows another embodiment of the invention wherein the main electrodes are taken out from the panel of FIG. 8 so as to be used for a display panel having high resolving power. In the above-mentioned embodiments, it is necessary to arrange the main electrodes and the auxiliary electrodes in parallel with small spaces therebetween. This makes it difficult to increase the density of the electrode arrangement to provide high resolving power.

In the embodiment of FIG. 10, the main electrodes are removed and the operation of the main electrodes is assumed by the auxiliary electrodes by applying the discharge sustaining drive voltage and the turn-on or turn-off pulse voltage to both ends of the auxiliary electrodes.

In accordance with the gas discharge display panel of the invention wherein the traverse line and the vertical line for realizing luminescence are selected to conduct a switching operation between the switching electrodes and the auxiliary electrodes and the display part and the switching part are assembled in the panel, the following desirable results are realized.

a. It is unnecesary to provide a switching circuit in an outer part so that the space occupied is small and the cost is low.
b. A signal required for switching can be generated by a binary code so that the signal system can be remarkably simplified.
c. It is possible to remarkably decrease the number of lines required for the interface between the panel and the outer part so that troublesome connections of the panel to the outer part can be eliminated. For example, in a panel having picture elements numbering $512 \times 512$, in the past it has been necessary to use lines $512 + 512 = 1024$. In accordance with the invention, the number of lines can be decreased to $(2 \log_2 512) \times 2 + 4 = 40$.
d. The discharge at the switching operation part can be used as a source of free electrons required for initiating a discharge (discharge seeds) at the display part.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A gas discharge display panel comprising:

a display part comprising main electrodes disposed to form a matrix through a discharge gap to form plural picture elements by generating luminescent dots at cross points of the main electrodes; and a switching operation part comprising:

auxiliary electrodes arranged with the main electrodes to control the initiation and termination of the discharge at selected cross points of the main electrodes, and switching electrodes respectively arranged to cross the auxiliary electrodes through the discharge gap and to select cross points of the auxiliary electrodes for discharge, the main electrodes being covered by thin dielectric layers.

2. A gas discharge display panel comprising:

a discharge part comprising a pair of substrates having plural parallel main electrodes disposed to cross the main electrodes through a discharge gap and to form plural picture elements by generating luminescent dots at cross points of the main electrodes; and a switching operation part comprising:

auxiliary electrodes disposed in parallel to the main electrodes to control the initiation and the termination of the discharge at selected cross points of the main electrodes by applying turn-on or turn-off pulses through resistors; and switching electrodes arranged to cross the auxiliary electrodes on one of the substrates to form a matrix in an area annexed to the area containing the main electrodes to select cross points of the auxiliary electrodes for discharge.

3. A gas discharge display panel comprising:

a display part comprising main electrodes arranged to form a matrix through discharge gaps and to which an AC sustaining drive voltage is applied through a first common outer electrode; and a switching operation part comprising:

auxiliary electrodes arranged in parallel to the main electrodes to control the initiation and termination of the discharge at selected cross points of the main electrodes by applying a turn-on or turn-off pulse from a second common outer electrode through resistors;

switching electrodes arranged to cross the auxiliary electrodes on a substrate to form the matrix in an area annexed to the area having the main electrodes so that voltage is selectively applied through selecting elements; and a dielectric layer disposed at selected cross points between the auxiliary electrodes and the switching electrodes to form the matrix so that the discharge at the cross points is prevented when negative voltage is applied to the switching electrodes to command the auxiliary electrodes to apply the turn-on pulse.

4. The gas discharge display panel according to claim 3 wherein the dielectric layer in the switching operation part is disposed in a binary system.

5. The gas discharge display panel according to claim 4 wherein the switching operation part comprises a first matrix for selecting character positions and a second matrix for selecting character patterns.

6. The gas discharge display panel according to claim 2 wherein the auxiliary electrodes respectively have discharge spaces between the display part and the switching operation part and the auxiliary electrodes in the display part are connected through resistors to a discharge sustaining drive voltage.

7. The gas discharge display panel according to claim 6 wherein the auxiliary electrodes in the display part and the auxiliary electrodes in the switching operation part are disposed on two different substrates.

8. The gas discharge display panel according to claim 6 wherein auxiliary electrodes are used instead of main electrodes.

* * * * *